US008866692B2

(12) United States Patent
Vazquez et al.

(10) Patent No.: US 8,866,692 B2
(45) Date of Patent: Oct. 21, 2014

(54) ELECTRONIC DEVICE WITH ISOLATED ANTENNAS

(75) Inventors: Enrique Ayala Vazquez, Watsonville, CA (US); Bing Chiang, Cupertino, CA (US); Hao Xu, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 239 days.

(21) Appl. No.: 12/340,610

(22) Filed: Dec. 19, 2008

(65) Prior Publication Data

US 2010/0156741 A1 Jun. 24, 2010

(51) Int. Cl.

| | |
|---|---|
| ***H01Q 1/48*** | (2006.01) |
| ***H01Q 1/24*** | (2006.01) |
| ***H01Q 1/52*** | (2006.01) |
| ***H01Q 21/00*** | (2006.01) |

(52) U.S. Cl.

USPC ..... 343/846; 343/702; 343/841; 343/848; 343/853

(58) Field of Classification Search

USPC ..... 343/846, 702, 841, 848, 853; 455/575.5, 575.7, 296, 300

See application file for complete search history.

(56) References Cited

U.S. PATENT DOCUMENTS

| | | | | |
|---|---|---|---|---|
| 5,164,690 | A * | 11/1992 | Yeh et al. | 333/204 |
| 6,141,539 | A * | 10/2000 | Marino | 455/78 |
| 6,323,809 | B1 | 11/2001 | Maloney et al. | |
| 6,323,813 | B1 * | 11/2001 | Neat | 343/705 |
| 6,515,627 | B2 | 2/2003 | Lopez et al. | |
| 6,624,789 | B1 * | 9/2003 | Kangasvieri et al. | 343/702 |
| 6,781,371 | B2 * | 8/2004 | Taherian et al. | 324/303 |
| 6,933,909 | B2 | 8/2005 | Theobold | |
| 7,231,236 | B2 * | 6/2007 | Cho | 455/575.7 |
| 2003/0050032 | A1 * | 3/2003 | Masaki | 455/272 |
| 2004/0222928 | A1 * | 11/2004 | Chen | 343/702 |
| 2004/0257283 | A1 * | 12/2004 | Asano et al. | 343/702 |
| 2005/0254591 | A1 | 11/2005 | Weil | |
| 2006/0181468 | A1 * | 8/2006 | Iguchi et al. | 343/702 |
| 2007/0018649 | A1 * | 1/2007 | Prsha et al. | 324/326 |
| 2007/0040748 | A1 * | 2/2007 | Mei | 343/700 MS |
| 2007/0229387 | A1 | 10/2007 | Pelzer | |
| 2007/0268183 | A1 * | 11/2007 | Stutzke | 343/700 MS |

OTHER PUBLICATIONS

*Ex Parte Zechlin*, Associated with U.S. Appl. No. 11/448,265, Notification date of Jan. 18, 2011.*

Antenna Theory: A Review, Balanis, Proc. IEEE, vol. 80, No. 1, Jan. 1992.*

* cited by examiner

*Primary Examiner* — Graham Smith

(74) *Attorney, Agent, or Firm* — Treyz Law Group; G. Victor Treyz; David C. Kellogg

(57) ABSTRACT

Antennas for electronic devices are provided. First and second antennas may be mounted within an electronic device. Free-space coupling between the first and second antennas may give rise to interference. The first and second antennas may be coupled to a global ground. The global ground may be formed using a conductive member in the electronic device such as a conductive frame member. Signals that pass between the antennas through the global ground may serve as canceling signals that reduce the magnitude of free-space interference signals and thereby improve antenna isolation. The antennas may be coupled to the global ground using electrical paths or through near-field electromagnetic coupling. Coupling efficiency to the global ground may be enhanced by configuring the conductive traces of one or both of the antennas to form a resonant circuit.

20 Claims, 9 Drawing Sheets

ELECTRONIC DEVICE WITH ISOLATED ANTENNAS

BACKGROUND

This invention relates to electronic devices and, more particularly, to antennas for electronic devices.

Electronic devices often use wireless communications circuitry. For example, wireless communications circuitry is used in wireless base stations to support communications with computers and other wirelessly networked devices.

Some electronic devices use multiple antennas. For example, a device may use a first antenna to support operations in a first set of communications bands and may use a second antenna to support operation in a second set of communications bands. By using multiple antennas, band coverage may be increased or multiple-input multiple-output (MIMO) antenna schemes may be implemented.

Particularly in electronic devices of relatively small size, it may be necessary to locate different antennas in close proximity. This can cause undesirable coupling effects in which the operation of one antenna interferes with the operation of another antenna. It is therefore challenging to produce successful antenna arrangements in which multiple antennas operate in close proximity to each other without experiencing undesirable interference.

It would therefore be desirable to be able to provide improved antenna structures for wireless electronic devices.

SUMMARY

An electronic device is provided that has wireless communications capabilities. The electronic device may have a housing. The housing may contain storage and processing circuitry. A radio-frequency transceiver circuit may be coupled to the storage and processing circuitry. Multiple antennas may be coupled to the radio-frequency transceiver circuitry using respective transmission lines. For example, a first antenna may be coupled to the radio-frequency transceiver using a first coaxial cable and a second antenna may be coupled to the radio-frequency transceiver using a second coaxial cable. The first and second antennas may be single band or multiband antennas. For example, the first antenna may be a single band antenna that operates at 5 GHz, whereas the second antenna may be a dual band antenna that operates at 2.4 GHz and 5 GHz (as an example).

The electronic device may include a conductive structure such as a conductive frame member that serves as a global ground. The first and second antennas may each be electrically and/or electromagnetically coupled to the conductive structure. During operation, signals that are transmitted from one antenna may be received by the other antenna over a free-space path. These signals represent interference. The interference signal can be reduced using a deliberately created cancelling signal. The cancelling signal may be of comparable magnitude and opposite phase to that of the interference signal. The cancelling signal may be routed from one antenna to the other by coupling the antennas through the global ground. The presence of the global ground cancelling path serves to increase isolation between the first and second antennas. Increased isolation may, in turn, improve antenna performance in various modes of operation (e.g., single band and dual band operating modes and operating modes with both antennas transmitting, both antennas receiving, one antenna transmitting and the other antenna receiving, etc.).

To enhance coupling between the antennas and the global ground, one or both antennas may have traces that are configured to form a resonant circuit. For example, an antenna ground element may be formed from a C-shaped trace. The length of the ground element trace gives rise to an inductance for the resonant circuit. A gap in the ground element trace forms a capacitance in series with the inductance.

Further features of the invention, its nature and various advantages will be more apparent from the accompanying drawings and the following detailed description of the preferred embodiments.

DETAILED DESCRIPTION

The present invention relates to antennas for electronic devices. The antennas may be used to convey wireless signals for wireless communications links in any suitable communications bands. For example, the antennas may be used to handle communications for local area network links such as an IEEE 802.11 links (sometimes referred to as WiFi® links) or Bluetooth® links. The antennas may also be used to handle other communications frequencies, such as 2G and 3G cellular telephone frequencies. The antennas may be single band antennas or multiband antennas. A given electronic device may have two or more antennas that are isolated from each other to improve antenna performance.

An illustrative configuration in which two antennas are used to handle local area network signals is sometimes described herein as an example. In this type of illustrative configuration, a first antenna of the two antennas may be a single band antenna that handles IEEE 802.11 communications in the 5 GHz band and a second of the two antennas may be a dual band antenna that handles IEEE 802.11 communications in the 2.4 GHz and 5 GHz bands.

Antennas such as these may be used in various electronic devices. For example, the antennas may be used in an electronic device such as a handheld computer, a miniature or wearable device, a portable computer, a desktop computer, a router, an access point, a backup storage device with wireless communications capabilities, a mobile telephone, a music player, a remote control, a global positioning system device, devices that combine the functions of one or more of these devices and other suitable devices, or any other electronic device.

As is sometimes described herein as an example, the electronic device in which the antennas are provided may be a wireless base station such as a router or may be a miniature computer with wireless capabilities. The base station or computer may include local storage such as hard drive storage or solid state drive storage. These are, however, merely illustrative examples. Antennas may, in general, be provided in any suitable electronic device.

Figure 1:
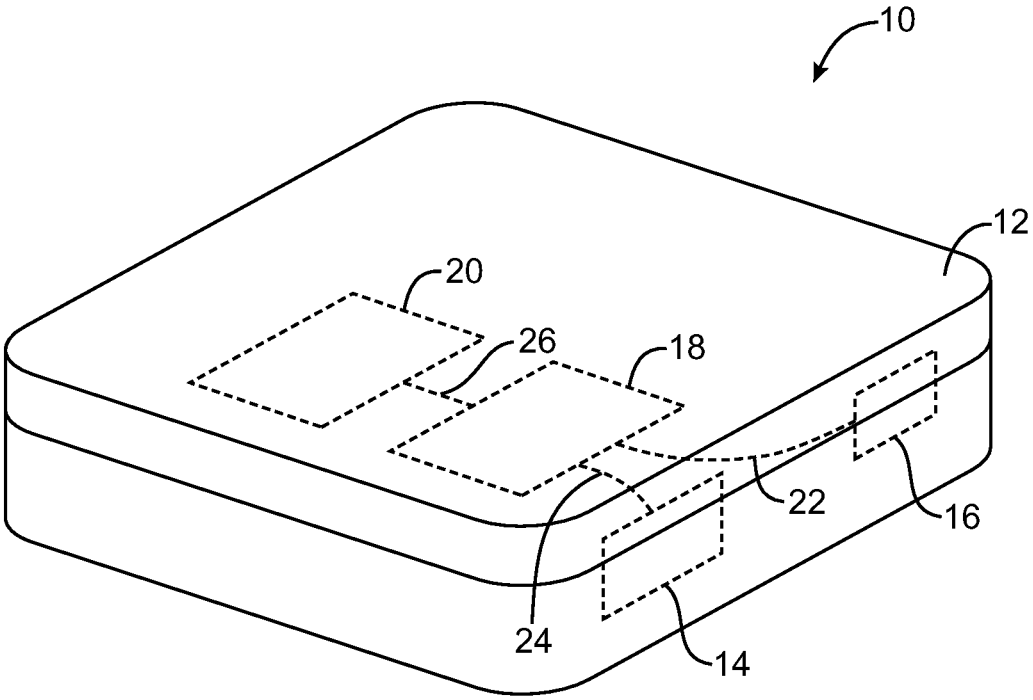
FIG. 1 is a perspective view of an illustrative electronic device such as a wireless base station or computer in which isolated antennas may be implemented in accordance with an embodiment of the present invention.

An illustrative electronic device 10 such as a wireless base station or computer in which the antennas may be provided is shown in FIG. 1. As shown in FIG. 1, device 10 may have a housing 12. Housing 12, which is sometimes referred to as a case, may be formed from one or more individual structures. For example, housing 12 may include structural support members and cosmetic coverings that are made from plastic and metal parts. Metal parts may be grounded and may serve as part of the antennas of device 10. Plastic parts and other dielectric parts are generally transparent to radio-frequency signals. Accordingly, it is generally desirable for the portions of housing 12 that enclose the antennas to be formed from dielectric materials. Conductive parts may be used for internal structures in device 10.

Device 10 may have antennas such as antennas 14 and 16. Radio-frequency transceiver circuitry 18 may include a radio-frequency receiver and a radio-frequency transmitter. Transmission line paths such as transmission lines 22 and 24 may be used to couple transceiver circuitry 18 to antennas 14 and 16. In the FIG. 1 example, transceiver circuitry 18 is connected to antenna 14 using transmission line 24 and is connected to antenna 16 by transmission line 22. Transmission lines 22 and 24 may be implemented using any suitable transmission line structures (e.g., cables, microstrip transmission line structures, etc.). With one suitable arrangement, which is sometimes described herein as an example, transmission lines 22 and 24 are implemented using coaxial cables.

Transceiver circuitry 18 may be coupled to circuitry such as storage and processing circuitry 20 using paths such as path 26. During data transmission operations, data from storage and processing circuitry 20 may be routed to transceiver 18 over path 26 and may be wirelessly transmitted to external equipment using transceiver 18 and antennas 14 and 16. During data reception operations, incoming radio-frequency signals may be received using antennas 14 and 16, paths 24 and 22, and transceiver circuitry 18. Transceiver circuitry 18 may provide received signals to storage and processing circuitry 20 over path 26.

For optimum wireless performance, it is desirable for antennas such as antennas 14 and 16 to interfere with each other as little as possible. Antenna interference can lead to degraded signal-to-noise ratios and reduced data communications throughput. Undesirable levels of interference can arise when antennas such as antennas 14 and 16 are placed in close proximity to each other. Due to the relatively small size of electronic devices such as device 10, it may be difficult or impossible to separate antennas 14 and 16 by extremely large distances. Nevertheless, satisfactory isolation between antennas 14 and 16 may be achieved by configuring the structures that make up antennas 14 and 16 so as to reduce interference.

With one suitable arrangement, antenna-to-antenna isolation levels of 30 dB or greater may be achieved (as an example). Isolation performance of this level may be achieved when operating antennas 14 and 16 in the same communications band (e.g., both in a first communications band) and may be achieved when operating antenna 14 in a first communications band and operating antenna 16 in a second communications band that is different than the first communications band. The first antenna, such as antenna 14 may, as an example, operate at a communications band of 5 GHz (e.g., for IEEE 802.11 communications), whereas the second antenna such as antenna 16 may operate at communications bands such as 2.4 GHz and 5 GHz bands (e.g., for IEEE 802.11 communications). While operating in this configuration, the first and second antennas may exhibit antenna isolations of more than 30 dB for both bands (2.4 GHz and 5 GHz) that are handled by the second antenna.

Figure 2:
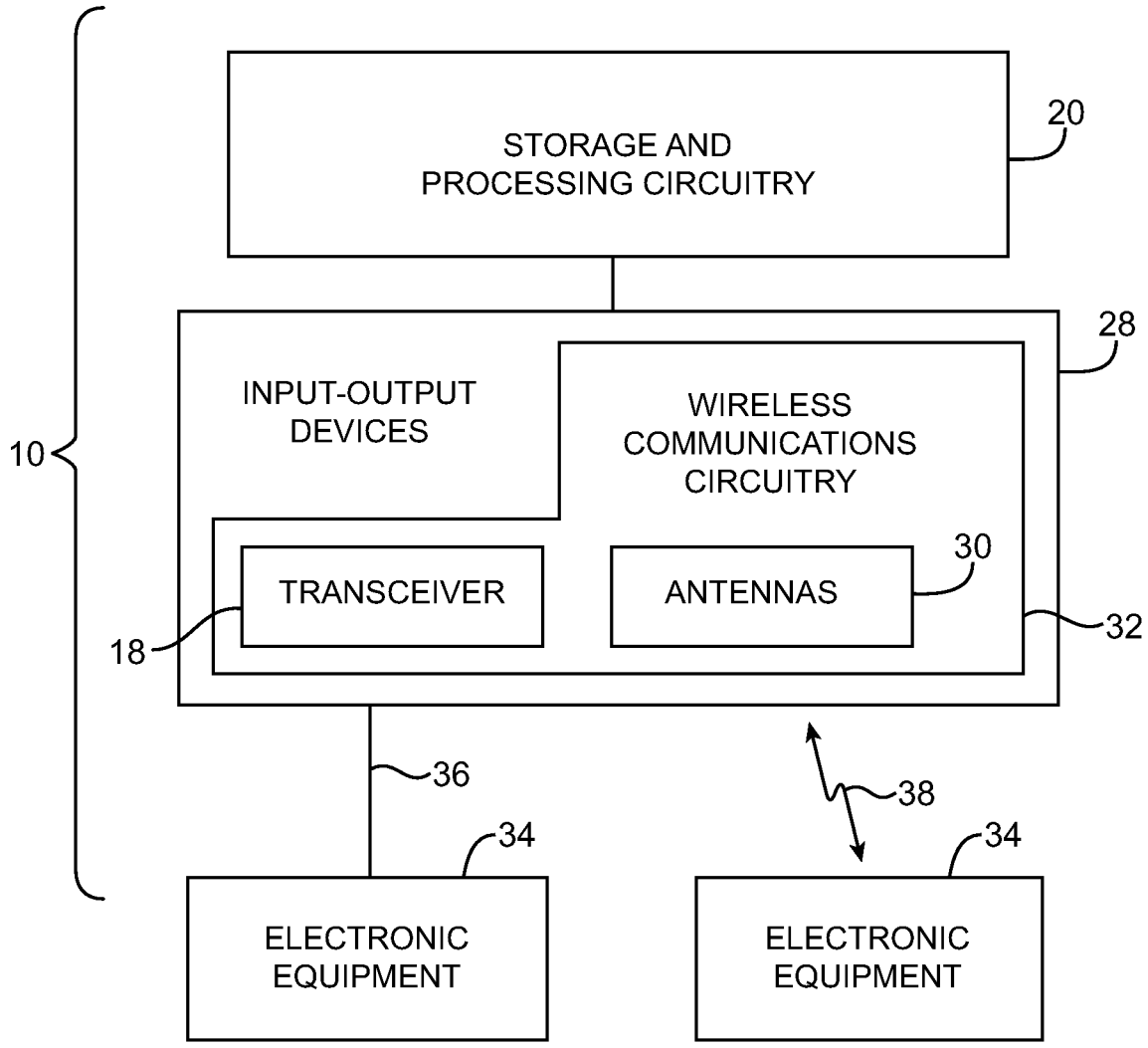
FIG. 2 is schematic diagram of an illustrative electronic device such as a wireless base station or computer in which isolated antennas may be implemented in accordance with an embodiment of the present invention.

A schematic circuit diagram of an illustrative electronic device such as device 10 of FIG. 1 is shown in FIG. 2. As shown in FIG. 2, device 10 may include storage and processing circuitry 20 and input-output devices 28. Storage and processing circuitry 20 may include hard disk drives, solid state drives, optical drives, random-access memory, nonvolatile memory and other suitable storage. Storage may be implemented using separate integrated circuits and/or using memory blocks that are provided as part of processors or other integrated circuits.

Storage and processing circuitry 20 may include processing circuitry that is used to control the operation of device 10. The processing circuitry may be based on one or more circuits such as a microprocessor, a microcontroller, a digital signal processor, an application-specific integrated circuit, and other suitable integrated circuits. Storage and processing circuitry 20 may be used to run software on device 10 such as operating system software, code for implementing the functions of a server with an array of one or more hard disk drives, solid state drives, or other server storage, software for implementing the functions of router or other communications hub, or other suitable software. To support wireless operations, storage and processing circuitry 20 may include software for implementing wireless communications protocols such as wireless local area network protocols (e.g., IEEE 802.11 protocols—sometimes referred to as Wi-Fi®), protocols for other short-range wireless communications links such as the Bluetooth® protocol, protocols for handling 3G communications services (e.g., using wide band code division multiple access techniques), 2G cellular telephone communications protocols, WiMAX® communications protocols, communications protocols for other bands, etc.

Input-output devices 28 may be used to allow data to be supplied to device 10 and to allow data to be provided from device 10 to external devices such as electronic equipment 34. Input-output devices 28 may include user input-output devices such as buttons, display screens, touch screens, joysticks, click wheels, scrolling wheels, touch pads, key pads, keyboards, microphones, speakers, cameras, etc. A user can control the operation of device 10 by supplying commands through the user input devices. This may allow the user to adjust settings such as security settings, etc. Input-output devices 28 may also include data ports, circuitry for interfacing with audio and video signal connectors, and other input-output circuitry.

As shown in FIG. 2, input-output devices 28 may include wireless communications circuitry 32. Wireless communications circuitry 32 may include communications circuitry such as radio-frequency (RF) transceiver circuitry 18 formed from one or more integrated circuits such as a baseband processor integrated circuit and other radio-frequency transmitter and receiver circuits. Circuitry 32 may include power amplifier circuitry, passive RF components, antennas 30 (e.g., antennas such as antennas 14 and 16 of FIG. 1), and other circuitry for handling RF wireless signals.

Device 10 may use wired data paths such as path 36 and wireless data paths such as path 38 to communicate with external equipment 34. External equipment 34 may include any suitable electronic equipment such as desktop computers, handheld computers and other portable computers, cellular telephones (e.g., multifunction cellular telephones with IEEE 802.11 capabilities), music players, remote controllers, peer devices (i.e., other equipment such as device 10), network equipment (e.g., in a local area network or in a cellular telephone network), etc. Wired paths such path 36 may be formed using wired data cables. Wireless paths such as path 38 may be formed by transmitting and receiving radio-frequency signals using antennas 30.

Any suitable technique may be used in device 10 to isolate antennas 14 and 16. For example, antennas 14 and 16 may be isolated using blocking techniques in which conductive structures are interposed between antennas 14 and 16 to mitigate interference. Isolation may also be improved by reducing antenna scattering through proper antenna placement, by using orthogonal antenna polarizations, by reducing common mode resonances, etc.

Figure 3:
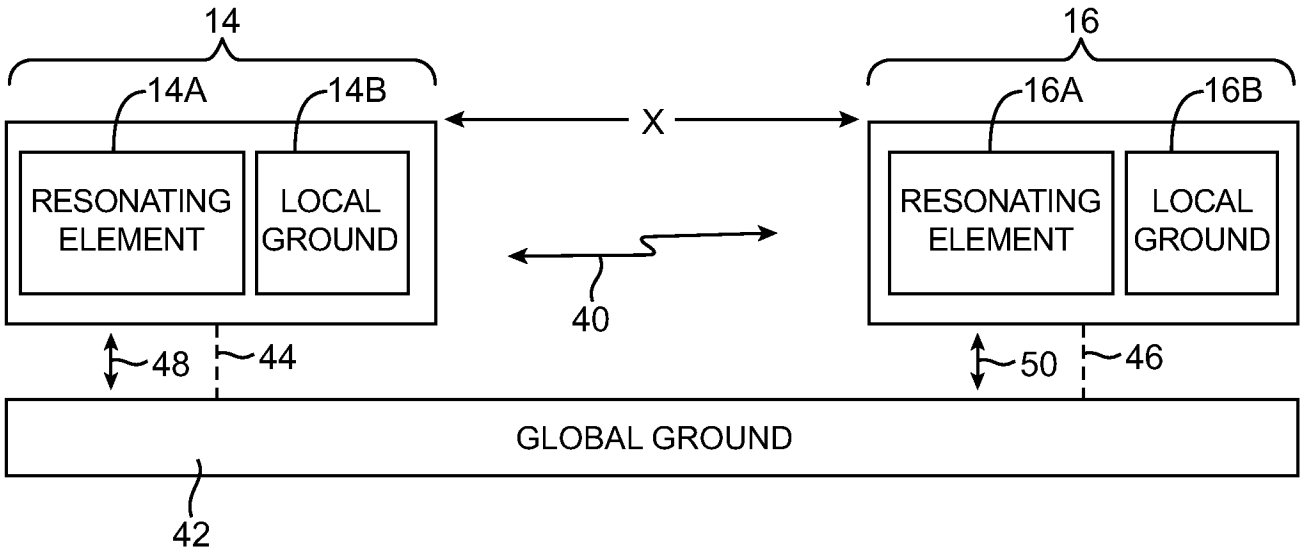
FIG. 3 is a schematic diagram of two isolated antennas that may be used in an electronic device such as a wireless base station or computer in accordance with an embodiment of the present invention.

An illustrative isolation scheme for antennas 14 and 16 is shown in the schematic diagram of FIG. 3. As shown in FIG. 3, antenna 14 and antenna 16 may be separated by a distance X. One way in which to improve the isolation between antenna 14 and antenna 16 is to increase distance X (e.g., to the largest distance possible within the confines of a desired device housing). When large values of distance X are used, the amount of radio-frequency signal coupling between antenna 14 and antenna 16 along free-space path 40 will generally be reduced. There may be scattering and reflective paths associated with the free-space coupling between antenna 14 and antenna 16. In general, however, the largest component of the free-space coupling between antenna 14 and antenna 16 will be associated with a relatively direct free-space path between antenna 14 and antenna 16.

With the configuration shown in FIG. 3, each antenna may have an antenna resonating element and an associated local antenna ground. A global ground such as ground 42 may be formed that spans both antennas. Antenna 14 may be formed from antenna resonating element 14A and local ground 14B. Antenna 16 may be formed from antenna resonating element 16A and local ground 16B. Antennas 14 and 16 may each interact with the conductive structures that make up global ground 42 (which may therefore be considered to form a part of antennas 14 and 16).

Antenna 14 may be coupled to global ground 42 by near-field electromagnetic coupling (illustrated by radio-frequency signal path 48 in FIG. 3). Antenna 16 may also be coupled to global ground 42 by near-field electromagnetic coupling (illustrated by radio-frequency signal path 50 in FIG. 3). If desired, conductive paths such as conductive paths 44 and 46 may be used to electrically couple antennas 14 and 16 to global ground 42, respectively.

Isolation may be improved by coupling antenna 14 to antenna 16 through global ground 42 such that the antenna signals from antenna 14 that reach antenna 16 through ground 42 cancel the signals from antenna 14 that reach antenna 16 through free-space path 40 (and vice versa). With this type of arrangement, signals that travel from antenna 14 along path 44 and/or path 48, path 42, and path 46 and/or path 50 have equal magnitude and are 180° out of phase with the signals that travel from antenna 14 to antenna 16 over free-space path 40.

The magnitude of the signal that reaches antenna 16 through path 42 can be increased by increasing the coupling between antenna 14 and ground 42 and by increasing the coupling between antenna 16 and ground 42. The phase of the cancelling signal traveling through ground 42 can be adjusted using matching components (e.g., resistors, inductors, capacitors, antenna elements with resistive, inductive, and capacitive properties, etc.), by making adjustments to the lengths of structures such as global ground 42 and paths 48, 44, 50, and 46, etc. Magnitude and phase adjustments such as these may be used to ensure that the cancelling signal between antennas 14 and 16 that passes through global ground 42 cancels other signals such as the signals conveyed over free-space path 40. Antenna 14 can be isolated from antenna 16 and antenna 16 can be isolated from antenna 14 in this way.

If desired, the antenna resonating element and local ground of antenna 14 and/or antenna 16 can be adjusted to create a resonating circuit (e.g., by adjusting inductive, capacitive, and resistive antenna components to form a circuit that resonates at frequencies associated with the operation of antennas 14 and/or 16). Resonant circuit behavior that is created in this way can enhance the coupling efficiency associated with antenna 14 and global ground 42 and the coupling efficiency associated with antenna 16 and global ground 42 to increase the magnitude of the cancelling signal. Resonant circuit effects can be used in combination with other antenna structure adjustments to adjust the amplitude and phase of the canceling signal provided through global ground path 42 to obtain maximum isolation between antennas 14 and 16.

Figure 4:
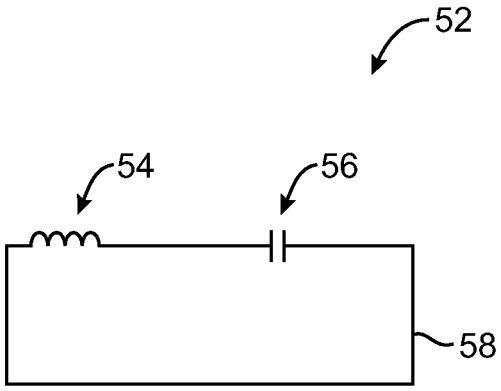
FIG. 4 is a circuit diagram of an illustrative resonant circuit for an antenna structure in accordance with an embodiment of the present invention.

An illustrative resonant circuit 52 that may be used in an antenna such as antenna 14 or antenna 16 is shown in FIG. 4. In the example of FIG. 4, resonant circuit 52 has been formed from series-connected inductor 54 and capacitor 56 in loop 58. This type of circuit will tend to resonate at frequencies around a given frequency f. By proper selection of the components of circuit 52, the resonant frequency f can be made to coincide with an operating frequency in a communications band of interest (e.g., the IEEE 802.11 bands at 2.4 and 5 GHz, as examples). When loop 58 is placed parallel to global ground 42 and close to global ground 42, near-field electromagnetic coupling (paths 48 and/or 50 in FIG. 3) will cause signals to be coupled between the antenna and the global ground and vice versa. If desired, other resonant circuit configurations may be used. The illustrative L-C circuit of FIG. 4 is merely illustrative.

Figure 5:
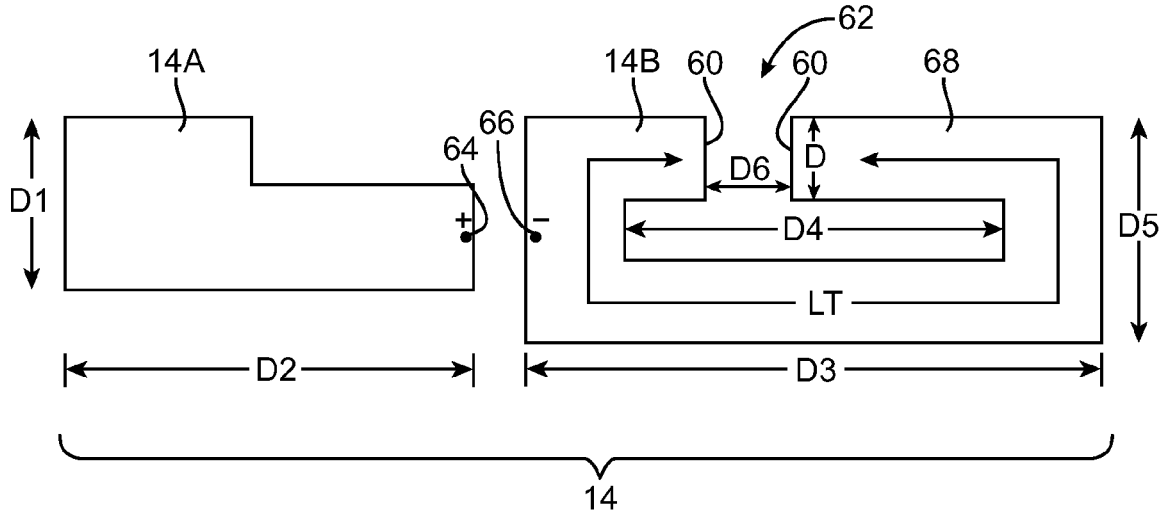
FIG. 5 is a diagram of illustrative antenna traces that may be used in an antenna that includes the resonant circuit of FIG. 4 in accordance with an embodiment of the present invention.

FIG. 5 shows an illustrative layout that may be used for antenna 14. As shown in FIG. 5, antenna 14 may have an antenna resonating element such as antenna resonating element 14A and a local ground such as local ground element 14B. Elements 14A and 14B may be formed from conductive traces such as copper traces or other metal traces on a supporting substrate such as a flex circuit, rigid printed circuit board, or plastic support structure. Any suitable dimensions may be used for the conductive structures that form elements 14A and 14B. For example, dimension D1 may be about 2-5 mm, dimension D2 may be about 4-8 mm, dimension D3 may be about 20-30 mm, dimension D4 may be about 10-15 mm, dimension D5 may be about 3-7 mm, and dimension D6 may be about 0.2-3 mm (as examples).

The dimensions of elements 14A and 14B can be selected to tune the electrical properties of antenna 14. For example, ground element 14B of FIG. 5 has a series inductance associated with the length LT of the C-shaped loop formed by trace 68. Ground element 14B also has a series capacitance formed by gap 62 between opposing trace ends 60. Ground element 14B forms a resonant L-C circuit of the type shown in FIG. 4. The length LT of trace 68 influences the amount of inductance associated with element 14B. If length LT is increased, the amount of inductance associated with element 14B will increase. Decreases in length LT will reduce the inductance of element 14B. The width D6 of gap 62 and the lateral dimensions of end faces 60 influence the amount of capacitance associated with element 14B. Larger end faces 60 (i.e., larger dimensions D) will exhibit more capacitance, whereas narrower end faces 60 will exhibit less capacitance. The size of dimension D6 can be reduced to increase the capacitance associated with gap 62 and can be increased to decrease the capacitance associated with gap 62. Adjustments can also be made to trace resistivity, substrate dielectric constant, etc.

Antenna 14 may be fed using any suitable feed arrangement. For example, a transmission line (transmission line 24 of FIG. 1) such as a coaxial cable or a microstrip transmission line may have a positive path connected to positive antenna feed terminal 64 and a ground (negative) antenna path connected to ground antenna feed terminal 66. Positive feed terminal 64 may be connected to antenna resonating element 14A. Ground feed terminal 66 may be connected to local antenna ground element 14B. To ensure optimum impedance matching between the antenna transmission line and antenna 14, an optional impedance matching network may be interposed between the transmission line and feed terminals 64 and 66. Impedance matching components may also be incorporated into the structures of antenna 14.

Figure 6:
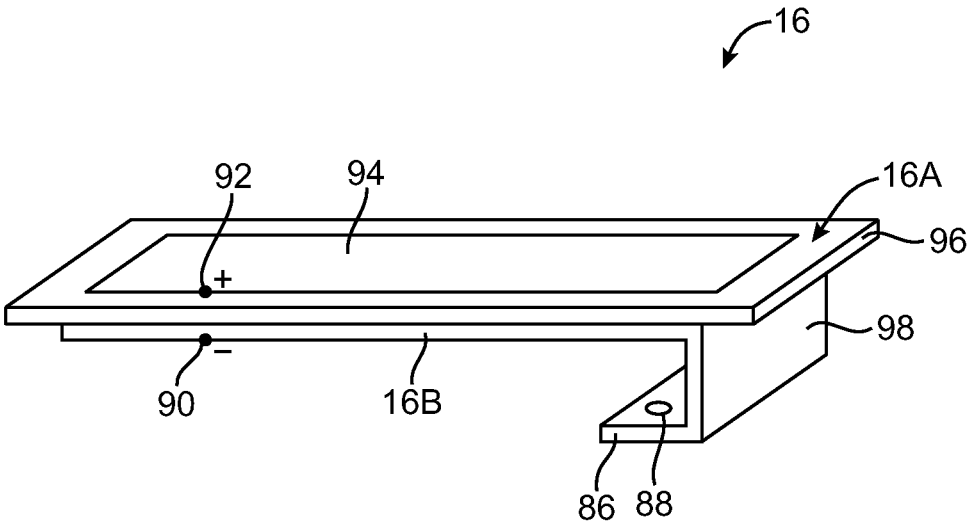
FIG. 6 is a diagram of illustrative antenna structures that may be used in another antenna in accordance with an embodiment of the present invention.

A perspective view of an illustrative configuration for antenna 16 is shown in FIG. 6. As shown in FIG. 6, patterned conductive traces 94 may be formed on substrate 96. Traces 94 may include planar trace patterns that define one or more branches, slots, or other antenna features for antenna resonating element 16A. Substrate 96 may be formed from printed circuit board material or other suitable dielectric. For example, substrate 96 may be formed from rigid printed circuit board material such as fiberglass-filled epoxy or flex circuit material such as polyimide. Substrate 96 may be mounted on bracket 98 or other suitable mounting structures using conductive adhesive or other suitable mounting arrangements.

Antenna 16 may be fed by connecting coaxial cable conductors or other transmission line paths in a path such as path 22 of FIG. 1 to antenna feed terminals such as positive antenna feed terminal 92 and ground antenna feed terminal 90. An impedance mating network may be used to improve impedance matching between transmission line 22 and antenna 16.

Bracket 98 may be formed from a conductive material such as metal and may be used in forming local ground 16B. Bracket 98 may be mounted to conductive structures in device 10 such as conductive structures that form global ground 42 (FIG. 3). Base portion 86 of bracket 98 may have screw holes such as hole 88. Screws or other fasteners that pass through holes 88 may be used to attach bracket 98 and antenna 16 to global ground 42. Conductive bracket 98 may form a conductive path between antenna 16 and global ground 42 such as path 46 in FIG. 3. If desired, a conductive bracket or other such conductive structure may also be used to electrically couple antenna 14 to global ground 42 (e.g., to form a path such as path 44 of FIG. 3).

Figure 7:
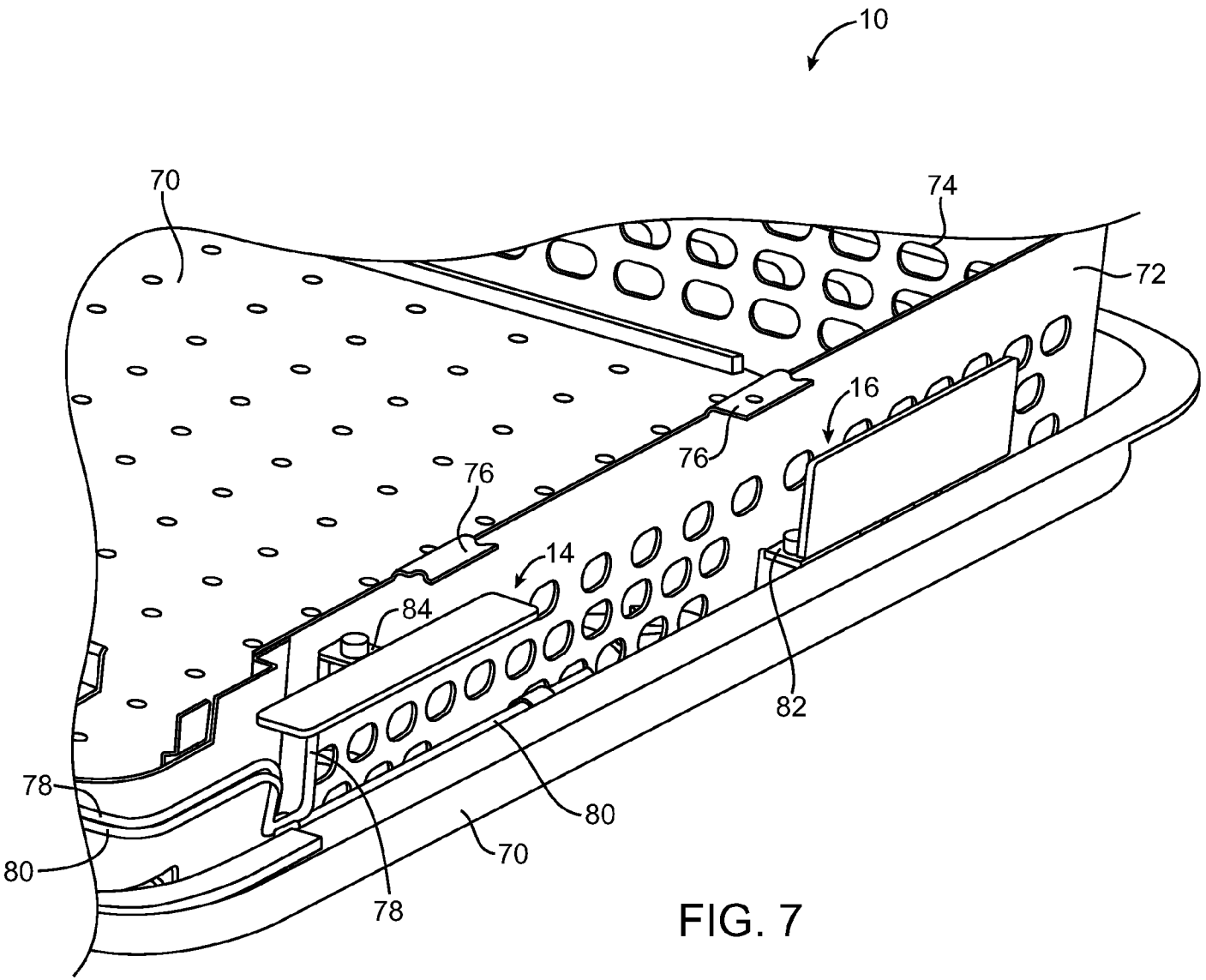
FIG. 7 is a perspective view of an interior portion of an illustrative electronic device with isolated antennas in accordance with an embodiment of the present invention.

FIG. 7 is a perspective view of an interior portion of an illustrative electronic device 10 with isolated antennas 14 and 16. As shown in FIG. 7, device 10 may have a base portion 70 and a frame portion 72. Holes 74 may be formed in frame member 72 (e.g., to reduce weight). Base 70 may be formed from materials such as metal and plastic. Frame 72 may be formed from a conductive material such as metal and may serve as global ground 42 of FIG. 3. Frame 72 may be formed from one or more individual members and may have features such as brackets 76. Brackets 76 may be used in supporting internal mounting structures such as antenna support structures. Brackets on frame 72 may also be used in attaching a top housing portion formed of metal or plastic or other housing structures to base structure 70 (e.g., to form a cube-shaped housing such as housing 12 of FIG. 1).

As shown in FIG. 7, antennas 14 and 16 may be mounted in device 10 in the vicinity of frame 72 or other conductive structural members associated with housing 12 and device 10. Transmission lines 78 and 80 may be grounded to frame 72 using brackets such as brackets 82 and 84. If desired, brackets 84 and 82 may serve as mounting structures and may optionally be used to form conductive coupling paths to the global ground structure formed from frame 72. Brackets 84 and 82 may be formed from a dielectric such as plastic, a conductive material such as metal, or other suitable materials. If desired, brackets 84 and 82 or portions of brackets 84 and 82 may be formed as integral parts of frame 72.

Antennas 14 and 16 may have substantially planar substrates on which patterned traces are formed. The planes of the substrates may be oriented to be orthogonal to each other as shown in FIG. 7 (e.g., to increase the amount by which the polarizations of the antennas differ and thereby increase isolation). Coaxial cable 78 may serve as transmission line 24 of FIG. 1 and may be used to couple transceiver circuitry 18 (FIG. 1) to antenna 14. Coaxial cable 80 may serve as transmission line 22 of FIG. 1 and may be used to couple transceiver circuitry 18 to antenna 16.

Figure 8:
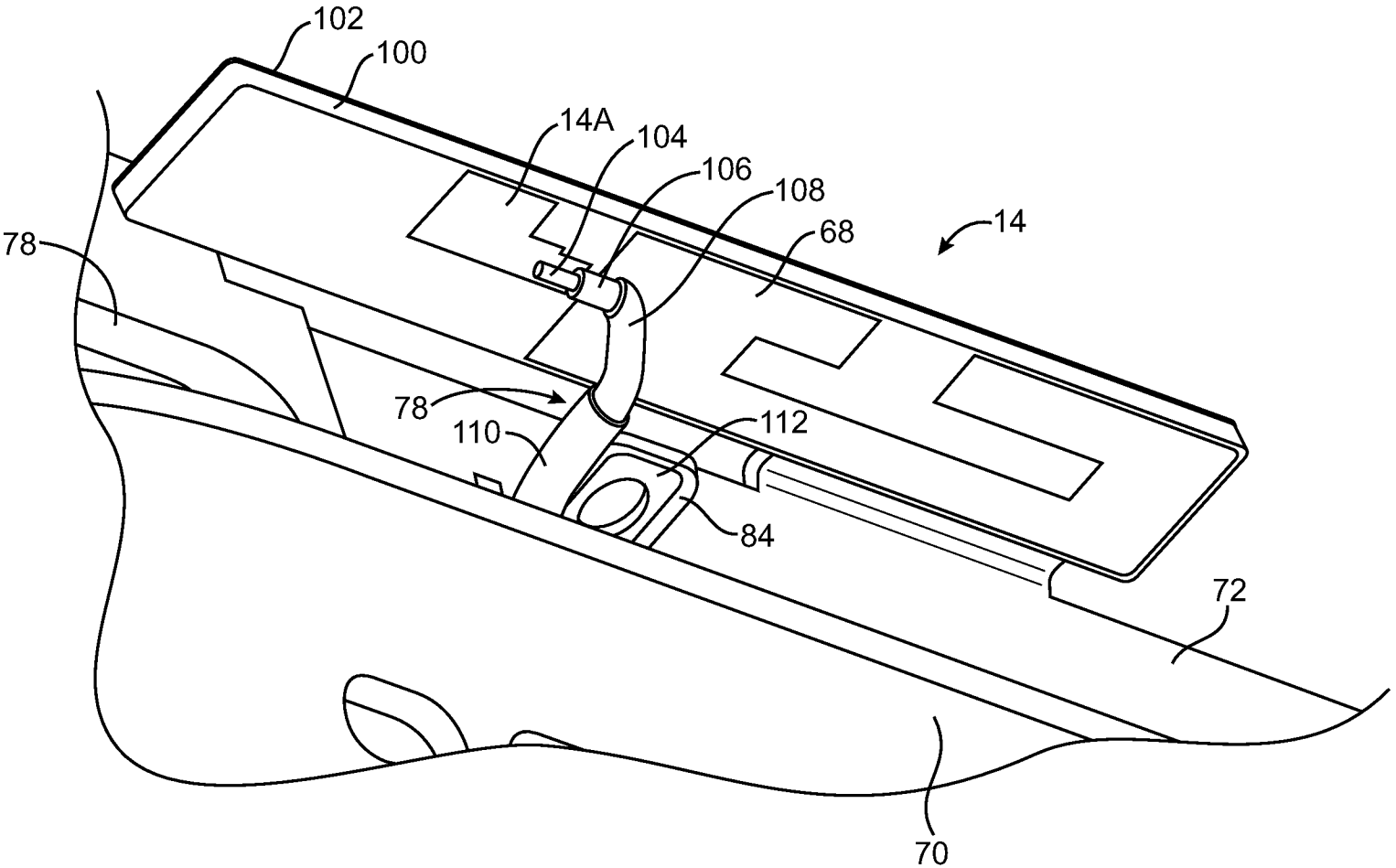
FIG. 8 is a perspective view of an illustrative antenna having an antenna element trace pattern of the type shown in FIG. 5 and that may be used in a device of the type shown in FIG. 7 in accordance with an embodiment of the present invention.

FIG. 8 is a perspective view of antenna 14 of FIG. 7 showing how antenna 14 may have patterned traces such as trace 68 and resonating element trace 14A formed on substrate 100. Substrate 100 may be formed from a rigid printed circuit board material, a flex circuit material such as polyimide, or other suitable dielectric materials. Adhesive 102 may be used to attach substrate 100 to an antenna mounting structure formed from plastic or other dielectric materials. Antenna 16 of FIG. 7 may also be mounted in device 10 using a dielectric mounting structure and adhesive.

Transmission line 78 may be a coaxial cable having center conductor 104, a dielectric layer 106, an outer conductor 108, and a plastic jacket 110. Clip 112 may be used in attaching cable 78 to frame 72 (e.g., at portion 82 using a screw). Center conductor 104 may be connected to antenna resonating element 14A at antenna feed terminal 66 (FIG. 5). Outer conductor 108 may be connected to ground antenna feed terminal 66 on local ground element 14B of antenna 14 (FIG. 5).

Figure 9:
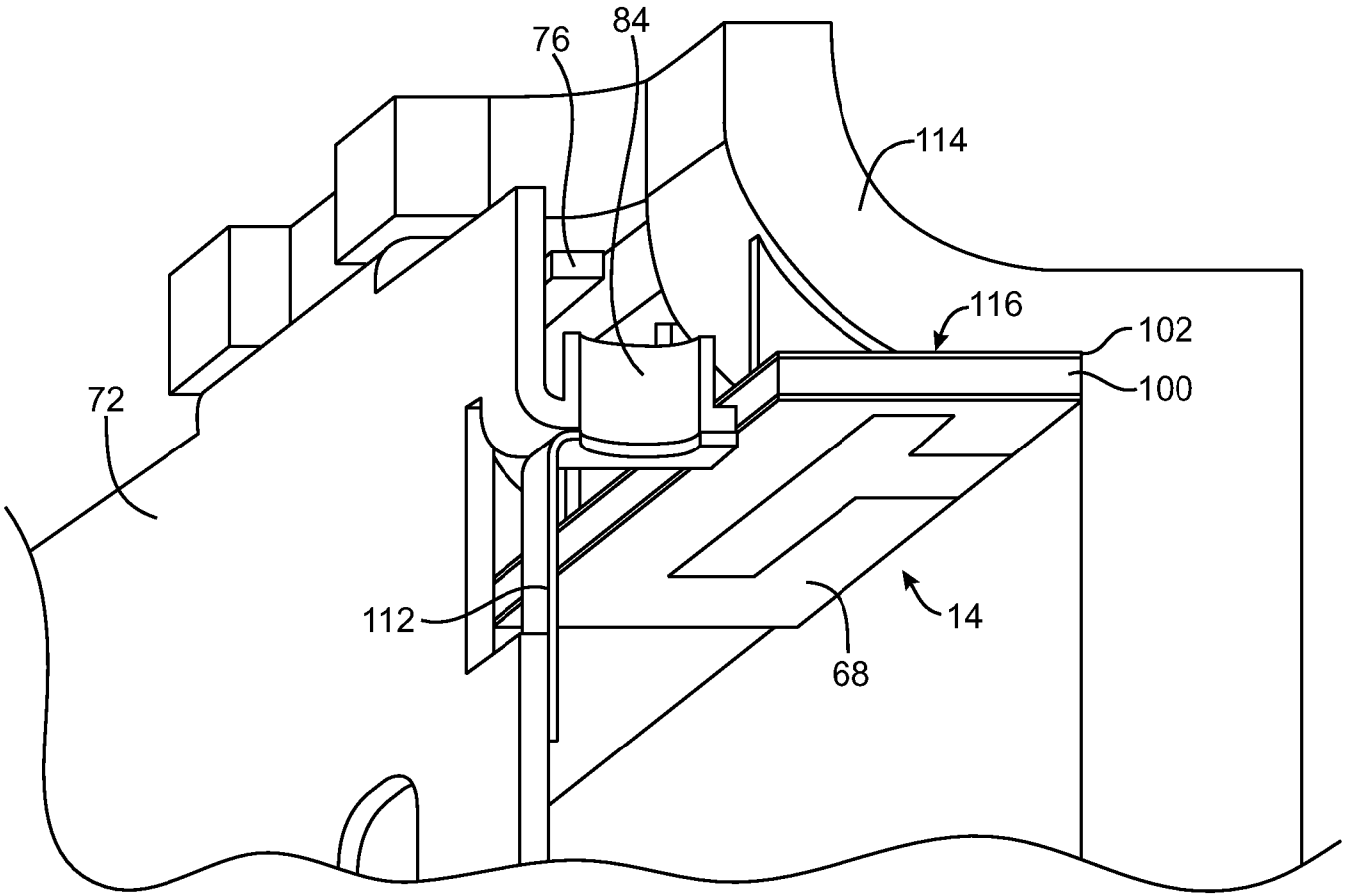
FIG. 9 is a cross-sectional perspective view of an illustrative antenna of the type shown in FIG. 8 in accordance with an embodiment of the present invention.

An illustrative antenna mounting structure to which antenna 14 may be mounted in device 10 is shown in FIG. 9. As shown in FIG. 9, substrate 100 of antenna 14 may be mounted to antenna mounting structure 114 at planar surface interface 116 using adhesive 102. Mounting structure 114 may be formed from a dielectric such as plastic or other suitable materials. Mounting structure 114 may form part of housing 12 and may be attached to frame 72 by bracket 76 (e.g., using screws, adhesive, or other suitable attachment structures). Antenna 16 may also be mounted in device 10 using a mounting structure such as mounting structure 114.

When antennas 14 and 16 are mounted within device 10 as shown in FIG. 7, radio-frequency signals may be transmitted and received using antennas 14 and 16 and radio-frequency transceiver 18. Antenna 14 may be configured to operate in one or more bands (e.g., at 5 GHz) and antenna 16 may be configured to operate in one or more bands (e.g., 2.4 GHz and 5 GHz).

Although antennas 14 and 16 are spaced apart to increase isolation, there will still be a free-space signal path such as path 40 of FIG. 3 between antennas 14 and 16 that can lead to undesirable electromagnetic coupling and signal interference. Isolation between antennas 14 and 16 can be improved using a cancelling signal path between antennas 14 and 16 formed by global ground 42 (a structure that is formed, in this example, using metal frame member 72). As described in connection with FIG. 3, free-space signal path 40 serves as a relatively direct path between antennas 14 and 16 and can lead to antenna interference. The signal path through global ground 42 serves as an indirect path through which canceling signals pass. The presence of the cancelling path serves to increase isolation between antennas 14 and 16, because cancelling path signals can cancel out signals that are coupled over free-space path 40.

Consider, as an example, a situation in which one antenna is transmitting. In this scenario, the free-space signal path (path 40) serves to convey a first version of a transmitted signal from a first of the antennas to a second of the antennas, whereas the path through global ground 42 serves to convey a second version of the same transmitted signal between the first and second antennas. The first version of the signal can serve as a source of interference for the second antenna. However, when cancelling path 42 is present, the first and second versions of the signal cancel each other at the second antenna, thereby reducing interference from the first version of the signal. Because the amount of interfering signal that is received at the second antenna from the first antenna is reduced, the isolation between the antennas is improved. This allows antennas 14 and 16 to be placed closer to each other in device 10 than would otherwise be possible and/or improves the wireless performance of device 10. The presence of path 42 can enhance antenna isolation regardless of the mode of operation of antennas 14 and 16 (e.g., transmitting, receiving, simultaneously transmitting and receiving, etc.).

The foregoing is merely illustrative of the principles of this invention and various modifications can be made by those skilled in the art without departing from the scope and spirit of the invention.

What is claimed is:

1. A computer, comprising:

a plastic housing having a top and a bottom and having four sides;

a metal frame member within the plastic housing, wherein the metal frame member extends along at least two of the four sides of the plastic housing;

a first antenna having a first antenna resonating element and a first antenna local ground; and a second antenna having a second antenna resonating element and a second antenna local ground, wherein the metal frame member forms a global ground structure that is coupled to the first antenna and that is coupled to the second antenna, wherein the electronic device is configured such that a first version of a transmitted antenna signal from the first antenna that is received at the second antenna through the global ground structure at least partially cancels a second version of the transmitted antenna signal from the first antenna that is received by the second antenna through a free-space path to increase isolation between the first and second antennas, wherein the first antenna resonating element comprises a first planar substrate that lies in a first plane, wherein the second antenna resonating element comprises a second planar substrate that lies in a second plane, wherein the first and second planar substrates each has first, second, and third dimensions, wherein the third dimension of the first planar substrate is smaller than the first and second dimensions of the first planar substrate, wherein the third dimension of the second planar substrate is smaller than the first and second dimensions of the second planar substrate, wherein the third dimension of the first planar substrate is perpendicular to the first plane, wherein the third dimension of the second planar substrate is perpendicular to the second plane, wherein the first plane is not parallel to the second plane, wherein the first and second antennas are disposed on a given one of the four sides of the plastic housing and are between the plastic housing and the metal frame member, wherein the metal frame member is planar and lies in a third plane along the given one of the four sides of the plastic housing, wherein the third plane is parallel to the first plane, wherein the first antenna comprises conductive traces that are configured to form an L-shaped antenna resonating element and wherein the L-shaped antenna resonating element has a maximum width of between 2 mm and 5 mm and has a maximum length of between 4 mm and 8 mm.

2. The computer defined in claim 1 wherein the first antenna comprises conductive traces that are configured to form a resonant circuit.

3. The computer defined in claim 1 wherein the first antenna local ground comprises a conductive trace having two ends spaced apart by a gap to form a series capacitance for a resonant circuit.

4. The computer defined in claim 3 wherein the first antenna local ground comprises a C-shaped conductive trace.

5. The computer defined in claim 1 wherein the first antenna local ground comprises a C-shaped conductive trace.

6. The computer defined in claim 1 wherein the first antenna comprises conductive traces that are configured to electromagnetically couple to the global ground structure.

7. The computer defined in claim 6 further comprising a conductive path between the second antenna and the global ground structure.

8. The computer defined in claim 1 further comprising a conductive path between the second antenna and the global ground structure.

9. The computer defined in claim 1 wherein the first antenna is a single band antenna that is configured to operate at 5 GHz and the second antenna is a dual band antenna that is configured to operate at 2.4 GHz and 5 GHz.

10. The computer defined in claim 1 wherein the first dimension of the first planar substrate is larger than the second and third dimensions of the first planar substrate, wherein the first dimension of the second planar substrate is larger than the second and third dimensions of the second planar substrate, and wherein the first dimension of the first planar substrate is parallel to the first dimension of the second planar substrate.

11. The computer defined in claim 1 wherein the metal frame member comprises an array of holes on the at least two of the four sides that the metal frame member extends along.

12. The computer defined in claim 1 further comprising:

a first conductive bracket that connects the first antenna to the metal frame member; and a second conductive bracket that connects the second antenna to the metal frame member.

13. A computer comprising:

a plastic housing having a top and a bottom and having four sides;

an internal metal frame member adjacent and parallel to a given side of the four sides of the plastic housing, wherein there is a gap between the internal frame member and the given side of the plastic housing;

first and second antennas disposed within the gap between the internal frame member and the given side of the plastic housing;

first and second brackets that short respective portions of the first and second antennas to the internal frame member, wherein the internal frame member comprises a global ground structure, wherein the first and second antennas are disposed at respective positions within the gap between the internal frame member and the given side of the plastic housing such that a first version of a transmitted antenna signal from the first antenna that is received at the second antenna through the internal metal frame member at least partially cancels a second version of the transmitted antenna signal from the first antenna that is received by the second antenna through a free-space path, wherein the first antenna comprises a local ground formed from a C-shaped conductive trace having two ends spaced apart by a gap that forms a series capacitance for a resonant circuit, wherein the C-shaped conductive trace has a maximum width of between 3 mm and 7 mm, wherein the C-shaped conductive trace has a maximum external length of between 20 mm and 30 mm, wherein the C-shaped conductive trace has a maximum internal length of between 10 mm and 15 mm, and wherein the gap is 0.2 mm to 3 mm between the two ends.

14. The computer defined in claim 13 wherein the computer does not include a display.

15. The computer defined in claim 14 wherein the internal frame member comprises a plurality of evenly-spaced holes along the given side of the plastic housing.

16. The computer defined in claim 15 wherein the internal frame member also extends along at least a second given side of the four sides of the plastic housing and wherein there is a gap between the internal frame member and the second given side of the plastic housing.

17. The computer defined in claim 16 wherein the internal frame member comprises a plurality of evenly-spaced holes along the second given side of the plastic housing.

18. The computer defined in claim 17 further comprising:

a base member adjacent and parallel to the bottom of the plastic housing, wherein the base member comprises an array of evenly-spaced holes.

19. The computer defined in claim 18 wherein the first antenna comprises conductive traces that are configured to form an L-shaped antenna resonating element and wherein the L-shaped antenna resonating element has a maximum width of between 2 mm and 5 mm and has a maximum length of between 4 mm and 8 mm.

20. The computer defined in claim 1 wherein the first antenna comprises a local ground formed from a C-shaped conductive trace having two ends spaced apart by a gap that forms a series capacitance for a resonant circuit, wherein the C-shaped conductive trace has a maximum width of between 3 mm and 7 mm, wherein the C-shaped conductive trace has a maximum external length of between 20 mm and 30 mm, wherein the C-shaped conductive trace has a maximum internal length of between 10 mm and 15 mm, and wherein the gap is 0.2 mm to 3 mm between the two ends.

* * * * *